US005957112A

United States Patent [19]

Takahashi et al.

[11] Patent Number: 5,957,112

[45] Date of Patent: Sep. 28, 1999

[54] INJECTOR ARRANGEMENT FOR ENGINE

[75] Inventors: Masanori Takahashi; Hitoshi Watanabe, both of Hamamatsu, Japan

[73] Assignee: Sanshin Kogyo Kabushiki Kaisha, Hamamatsu, Japan

[21] Appl. No.: 08/843,016

[22] Filed: Apr. 11, 1997

[30] Foreign Application Priority Data

Apr. 12, 1996 [JP] Japan ..... 8-115529

[51] Int. Cl.[6] ..... F02M 55/02

[52] U.S. Cl. ..... 123/469; 123/456

[58] Field of Search ..... 123/195 HC, 196 W, 123/468, 469, 456

[56] References Cited

U.S. PATENT DOCUMENTS

| | | | |
|---|---|---|---|
| 4,539,961 | 9/1985 | Atkins et al. | 123/469 |
| 4,686,941 | 8/1987 | Ariga . | |
| 4,776,313 | 10/1988 | Freismuth et al. | 123/468 |
| 4,860,710 | 8/1989 | Hafner et al. | 123/469 |
| 4,913,111 | 4/1990 | Ariga . | |
| 5,058,554 | 10/1991 | Takeda et al. | 123/468 |
| 5,123,399 | 6/1992 | Motoyama et al. . | |
| 5,163,406 | 11/1992 | Daly et al. | 123/456 |
| 5,176,111 | 1/1993 | Nakamura et al. . | |
| 5,186,140 | 2/1993 | Ueda et al. . | |
| 5,203,299 | 4/1993 | Ueda . | |
| 5,205,244 | 4/1993 | Nakamura et al. . | |
| 5,438,963 | 8/1995 | Tsunoda et al. | 123/195 HC |
| 5,553,586 | 9/1996 | Koishikawa et al. | 123/196 W |
| 5,611,313 | 3/1997 | Ashcraft | 123/456 |
| 5,687,696 | 11/1997 | Takagi et al. | 123/456 |

FOREIGN PATENT DOCUMENTS

| | | | |
|---|---|---|---|
| 0 512 235 | 11/1992 | European Pat. Off. | 123/469 |
| 37 39 108 | 6/1989 | Germany | 123/469 |
| 64-35073 | 2/1989 | Japan | 123/469 |

*Primary Examiner*—Erick R. Solis
*Attorney, Agent, or Firm*—Knobbe, Martens, Olson & Bear LLP

[57] ABSTRACT

A fuel injector arrangement for an internal combustion engine of the type utilized to power an outboard motor of a watercraft is disclosed. The engine is oriented with its crankshaft vertically extending, such that the engine has a top and a bottom, a first end and a second end, and a side between the ends. An intake passage leads through a side of the engine to a combustion chamber therein. A fuel injector is positioned along the side of the engine and arranged to deliver fuel into air flowing through the passage. In one arrangement, the fuel injector is connected to an intake manifold connected to the side of the engine and having a passage therethrough leading to the intake passage. In this arrangement, a fuel delivery passage is formed in the manifold through which fuel is delivered to the injector. In a second embodiment, the fuel injector is connected to a cylinder head of the engine and the fuel delivery passage is formed in the cylinder head.

11 Claims, 9 Drawing Sheets

INJECTOR ARRANGEMENT FOR ENGINE

FIELD OF THE INVENTION

The present invention relates to a fuel injection system for an internal combustion engine.

BACKGROUND OF THE INVENTION

Watercraft are often powered by outboard motors positioned at the stern of the craft. These motors have an internal combustion engine positioned within a cowling of the motor. For among other reasons, because the outboard motor is positioned at the stern of the craft, and because the motor is tiltable, it is desirable to keep the engine's size and weight to a minimum.

These engines are oriented within the cowling such that the crankshaft of the engine is vertically extending. In this arrangement, a cylinder head is positioned at one end of the engine and a crankcase chamber at the other. The combustion chambers are arranged vertically, and the cylinder head has a top end and a bottom end.

Fuel is supplied to the combustion chambers of many of these engines with fuel injectors. These engines typically have the fuel injectors positioned to spray fuel directly into the combustion chamber or into air flowing past the injector through a passage leading to the combustion chambers.

In order to arrange the fuel injectors as described above, the fuel injectors are spaced vertically along the cylinder head from its top to bottom end for projection into the combustion chambers or corresponding adjacent intake passage through the cylinder head. A fuel rail extends along the outside of the cylinder head at that end of the engine for supplying fuel to the fuel injectors. This arrangement causes the engine's profile from its front end to its rear end to increase, causing the entire outboard motor to be larger. This change makes more difficult the tilt or trim function, since the motor's size increases in the same direction as it must be moved.

A fuel injection system for an engine where the injection system does not undesirably increase the profile of the engine, is desirable.

SUMMARY OF THE INVENTION

In accordance with the present invention there is a fuel injector arrangement for an engine of the type utilized to power an outboard motor. The engine is positioned within a cowling of the outboard motor so as to have a top end and a bottom end and a vertically extending crankshaft. The engine has at least one combustion chamber therein and an intake passage leading through the engine to the combustion chamber.

In accordance with the present invention, a fuel injector is positioned along the side of the engine for delivering fuel to air flowing through the intake passage into the combustion chamber. Preferably, the injector is arranged to deliver fuel generally parallel to the flow of air through the passage.

In addition, a fuel delivery passage through which fuel is delivered to the fuel injector is preferably provided in the engine. In one arrangement, where the fuel injector is mounted to a cylinder head of the engine, the fuel delivery passage is formed within the cylinder head. In another arrangement, the fuel injector is mounted to an intake manifold positioned at the side of the engine and the fuel delivery passage is provided through the intake manifold.

In an alternate embodiment, the fuel injector is mounted to a protective mounting element connected to the intake manifold. In this embodiment, the fuel delivery passage is formed within the mounting element.

In one arrangement, the fuel injector is oriented so as to lie along a horizontal plane. In another arrangement, the fuel injector is tilted to that a body end thereof is closer the top end of the engine than an injector end.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

In accordance with the present invention, there is provided an outboard motor 20 powered by an engine 22 having a fuel injector arrangement in accordance with the present invention.

Figure 1:
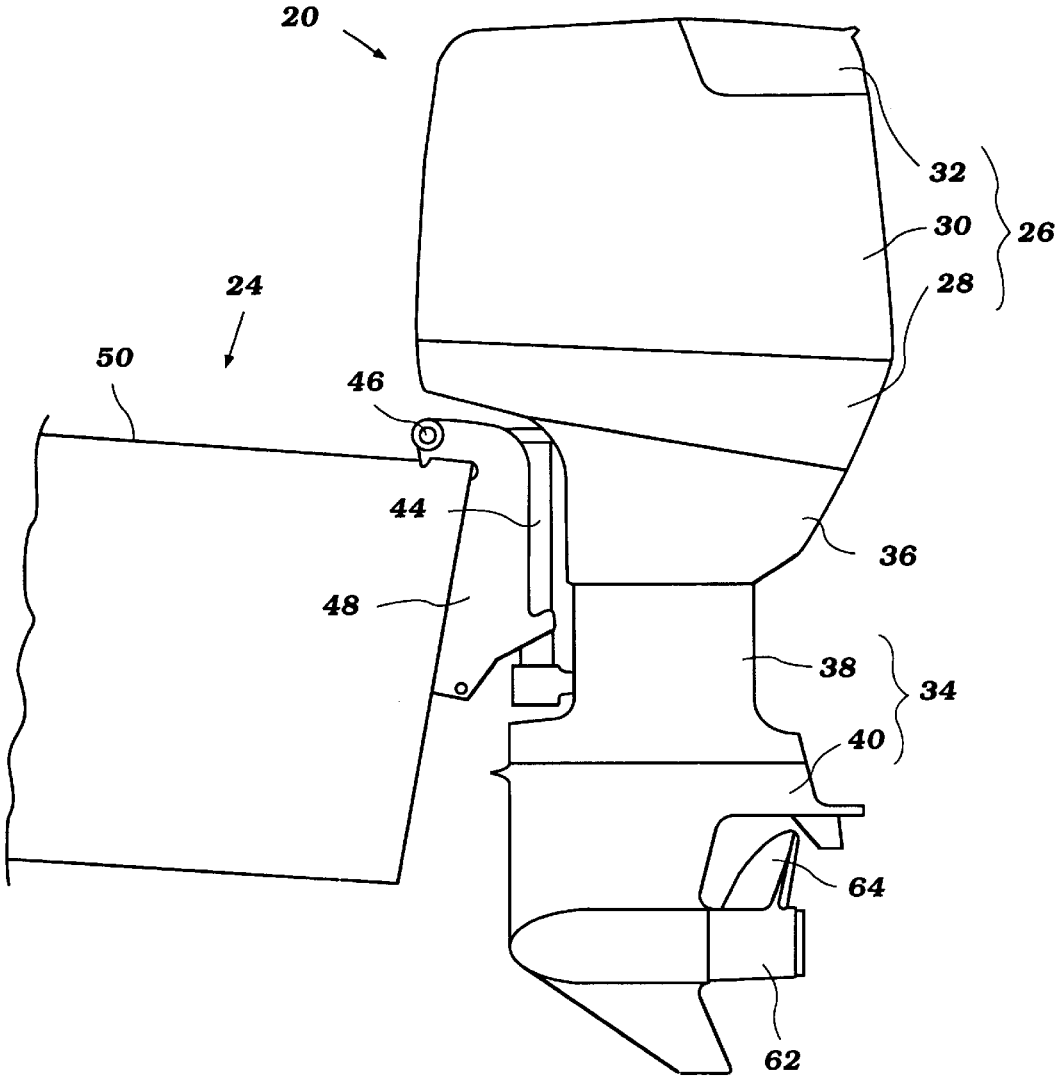
FIG. 1 is a side view of an outboard motor of the type powered by an internal combustion engine having a fuel injector arrangement in accordance with the present invention.

As best illustrated in FIG. 1, the outboard motor 20 is utilized to power a watercraft 24. The outboard motor 20 has a powerhead area 26 comprised of a lower tray portion 28 and a main cowling portion 30. An air inlet or vent area 32 is provided in the main cowling portion 30 for providing air to an engine 22 therein, and for exhausting heated air from within the cowling 30, as described in more detail below. The motor 20 includes a lower unit 34 extending downwardly therefrom, with an apron 36 providing a transition between the powerhead 26 and the lower unit 34. The lower unit 34 comprises an upper or "drive shaft housing" section 38 and a lower section 40.

A steering shaft, not shown, is affixed to the lower section 40 of the lower unit 34 by means of a bracket 42. The steering shaft is supported for steering movement about a vertically extending axis within a swivel bracket 44. The swivel bracket 44 is connected by means of a pivot pin 46 to a clamping bracket 48 which is attached to a transom portion of a hull 50 of the watercraft. The pivot pin 46 permits the outboard motor 20 to be trimmed and tilted up about the horizontally disposed axis formed by the pivot pin 46.

Figure 2:
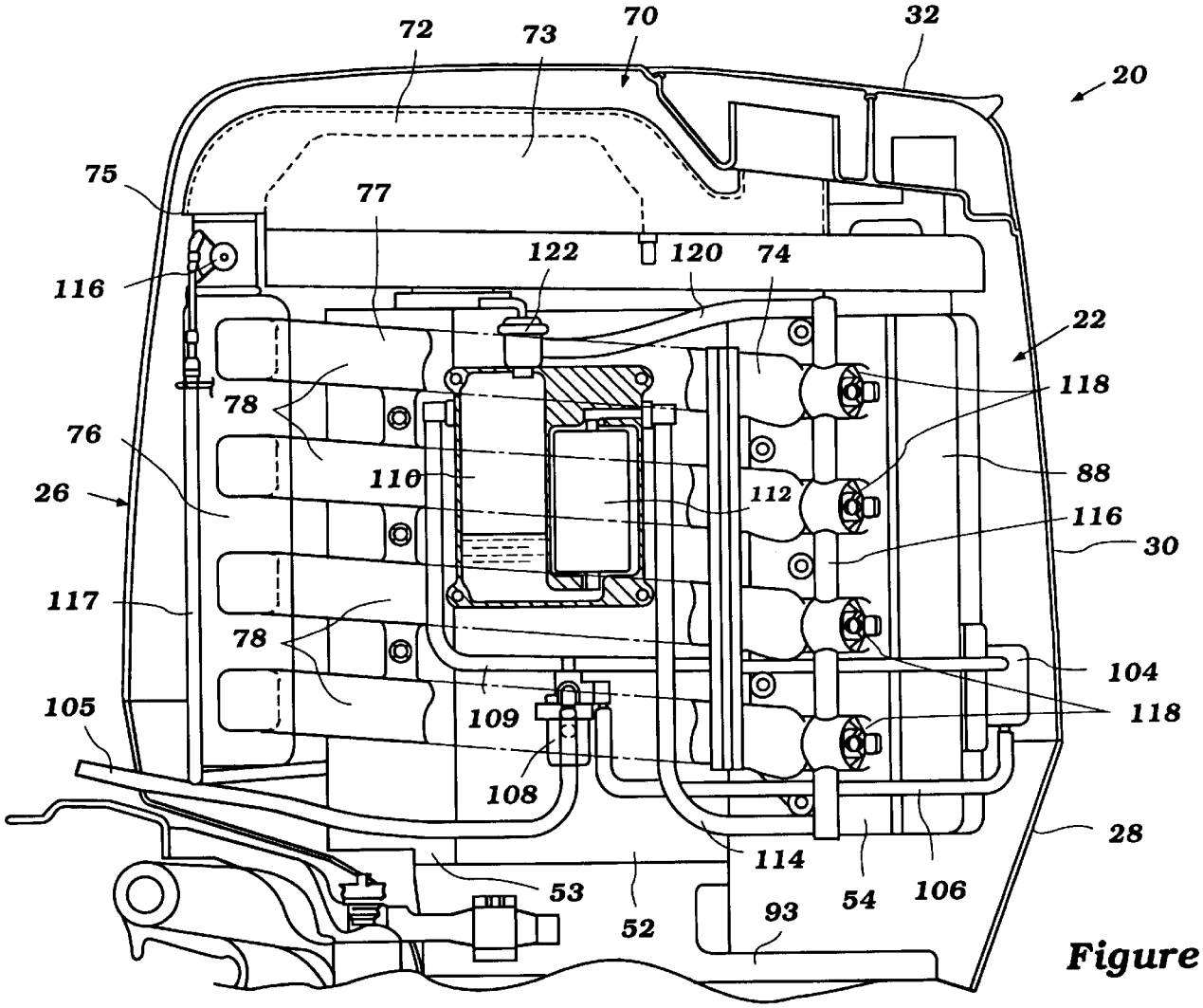
FIG. 2 is a cross-sectional side view of a top portion of the motor illustrated in FIG. 1, exposing the engine therein, portions of which are illustrated in cross-section, the engine having a fuel injector arrangement in accordance with a first embodiment of the present invention.

As best illustrated in FIG. 2, the power head 26 of the outboard motor 20 includes the engine 22 which is positioned within the cowling portion 30. The engine 22 is preferably of the inline, four-cylinder, four-cycle variety, and thus includes a cylinder block 52 which has a cylinder bank closed by a cylinder head assembly 54 in a manner which will be described. As also illustrated in FIG. 2, the engine 22 is preferably oriented within the cowling 30 such that its cylinder head 54 is positioned on the block 52 on the end opposite the watercraft's transom. So oriented, the engine 22 has a top, a bottom, a first end (where the cylinder head 54 is positioned, facing away from the watercraft 24) a second end (where a crankcase 57 is positioned, facing the watercraft 24), and two opposing sides between the ends.

Figure 3:
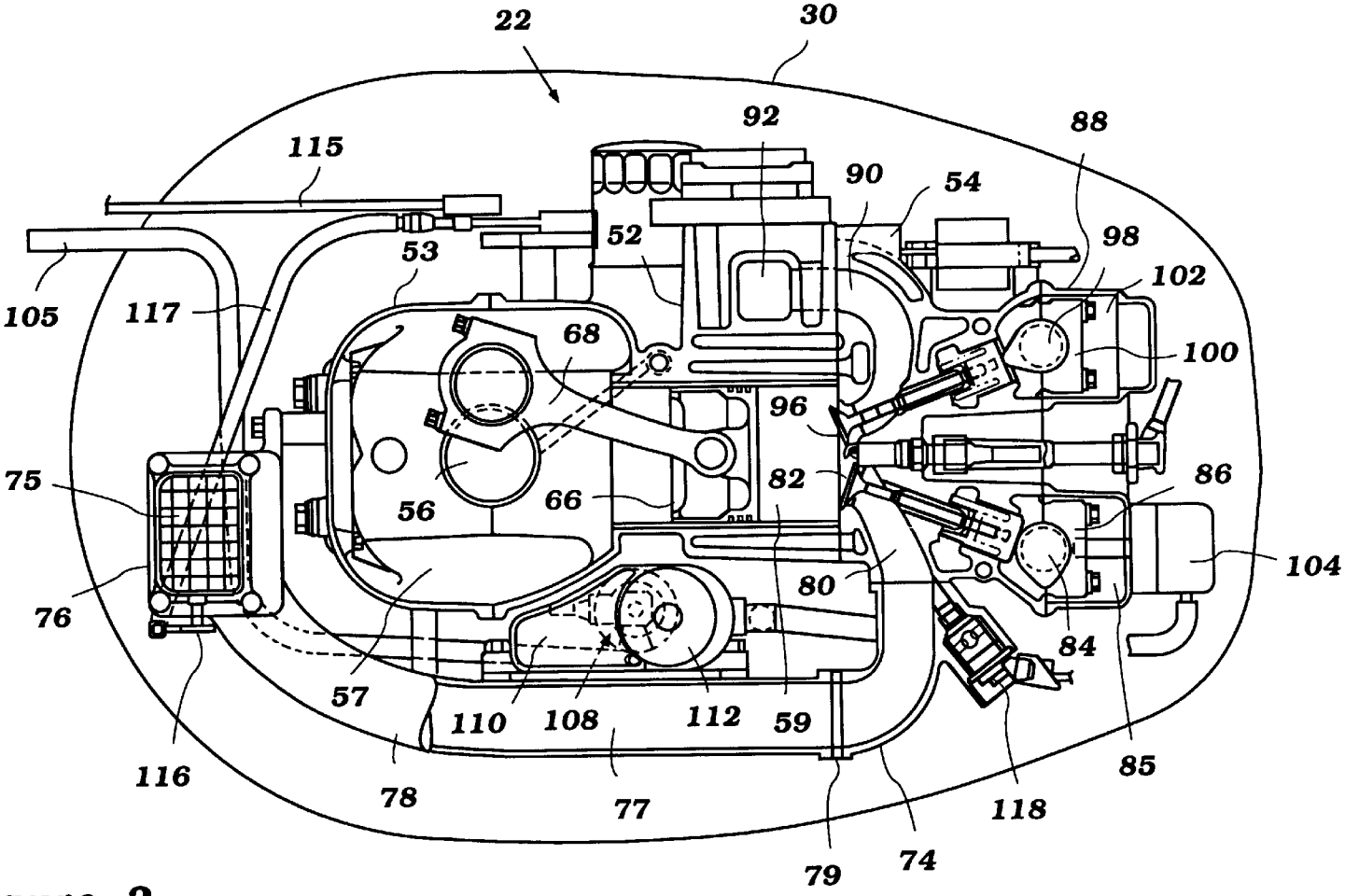
FIG. 3 is a cross-sectional top view of the motor and engine illustrated in FIG. 2.

As best illustrated in FIG. 3, a crankshaft 56 is rotatably journalled in a crankcase chamber 57 formed by the cylinder block 52 and a crankcase cover 53. As is typical with outboard motor practice, the engine 22 is mounted in the power head 26 so that the crankshaft 56 rotates about a vertically extending axis. This facilitates coupling to a drive shaft (not shown) which depends into the lower unit 34, wherein it drives a bevel gear and a conventional forward-neutral-reverse transmission. The transmission is not illustrated herein, because its construction per se forms no part of the invention. Therefore, any known type of transmission may be employed. A control is preferably provided for allowing an operator to remotely control the transmission from the watercraft 24.

The transmission drives a propeller shaft which is journalled within the lower section 40 of the lower unit 34 in a known manner. A hub 62 of a propeller 64 is coupled to the propeller shaft for providing a propulsive force to the watercraft 24 in a manner well known in this art.

The construction of the engine 22 and the fuel injection arrangement of the present invention will now be described in more detail. As illustrated in FIG. 3, the engine 22 has a number of variable volume combustion chambers 59, preferably totaling four in number, arranged in vertical inline fashion. It should be understood that there may be as few as one combustion chamber, or more than four.

Each combustion chamber has a piston 66 mounted therein for reciprocation, the piston connected to the crankshaft 56 via a connecting rod 68. The cylinder head 54 is preferably connected to the cylinder block 52 via a number of bolts, as is known in the art.

As illustrated in FIGS. 2 and 3, an intake system 70 provides air to each combustion chamber. Air passes through the cowling 30 at the vent portion 32. The air then passes through a passage 72 in the cowling 30 to a surge tank 76 positioned at the second end of the engine 22. The passage 72 is preferably defined by a camshaft drive cover 73 which extends over the top end of the engine 22.

More particularly, air is routed from the passage 72 through an intake 75 of the surge tank 76. Air is then routed from the surge tank 76 through passages 77 formed in runners 78 to passages extending through an intake manifold 74. The number of runners 89 equals the number of combustion chambers 59. Preferably, a gasket 79 is positioned between the connected runners 78 and manifold 74. The runners 78 extend from the second end of the engine along a side of the engine 22 to the manifold 24 which is positioned along the side of the engine 22 via connection to the cylinder head 54.

The manifold 74 has a number of passages extending therethrough equal to the number of runners 78. Each passage through the manifold 74 leads to a corresponding passage 80 positioned within the cylinder head 54 leading to the combustion chamber 59. An inlet passage 80 is provided corresponding to each combustion chamber 59. As illustrated, the manifold 74 is arranged so that the passages therein bend or curve towards the engine 22 from the passage 77 in the runner. The total bend is approximately 90° in the embodiment illustrated, as the inlet passages 80 extend through the side of the cylinder head 54.

Means are provided for controlling the passage of air through each inlet passage 80 to its respective combustion chamber 59. Preferably, this means comprises an intake valve 82. As illustrated, all of the intake valves 82 are preferably actuated by an intake camshaft 84. The intake camshaft 84 is mounted for rotation with respect to the head 54 and connected thereto with at least one bracket 86. The camshaft 84 is positioned in a chamber 85 formed by a cover 88 which is connected to the head 54.

An exhaust system is provided for routing the products of combustion within the combustion chambers 59 to a point external to the engine 22. In particular, an exhaust passage 90 leads from each combustion chamber to a passage 92 in an exhaust manifold portion 94 of the engine 22. The passage 92 leads through an exhaust guide 93 to an exhaust chamber and outlet in the lower unit 34, as is well known to those skilled in the art.

Means are also provided for controlling the flow of exhaust from each combustion chamber 59 to its respective exhaust passage 92. Preferably, this means comprises an exhaust valve 96. Like the intake valves 82, the exhaust valves 96 are preferably all actuated by an exhaust camshaft 98. The exhaust camshaft 98 is journalled for rotation with respect to the cylinder head 54 and connected thereto with at least one bracket 100. The exhaust camshaft 98 is positioned within a chamber 102 formed by the cover 88.

Though not illustrated, means are provided for driving the camshafts 84,98. A variety of drive arrangements may be provided, as known to those skilled in the art. One such arrangement is that which includes a timing belt pulley mounted on a top end of the crankshaft 56 positioned outside of the cylinder block 52, and just below a flywheel (not shown) also positioned on the crankshaft 56. An exhaust camshaft pulley is mounted on an end of the exhaust camshaft extending from the top end of the engine 22, and an intake camshaft pulley is mounted on an end of the intake camshaft 84 extending from the top end of the engine. A drive belt extends around the timing belt pulley and the exhaust and intake camshaft pulleys, whereby the camshaft 56 indirectly drives the camshafts. One or more tensioner pulleys may be provided for maintaining the belt in a taunt condition.

A throttle 116 is provided for controlling the flow of air into the runners 78. Preferably, the throttle 116 comprises a moveable plate positioned in the inlet 75 of the surge tank 76. The throttle 116 is preferably controlled by a cable 117 which is connected to a throttle control 115 in the form of a cable extending from a control area of the watercraft 24, whereby the operator of the watercraft may control the throttle remotely therefrom.

A suitable ignition system is provided for igniting an air and fuel (the fuel being provided with the fuel system described in detail below) mixture within each combustion chamber 59. Such systems are well known to those skilled in the art, and as such forms no portion of the invention herein, such is not described in detail here.

The engine 22 includes a lubricating system for providing lubricant to the various portions of the engine. The lubricating system is not described in detail here, and may be of a variety of types found suitable to those skilled in the art.

The engine 22 also preferably includes a liquid cooling system. As the cooling system does not comprise a portion of the present invention, it is not described in detail herein. As is known to those skilled in the art, however, the cooling system generally includes a pump for drawing cooling water from the body of water in which the motor 20 is operating, and distributing it throughout coolant passages in the engine 22. In addition, the cooling system may include one or more exhaust system cooling jackets for cooling the exhaust system.

A fuel delivery system is provided for delivering fuel to each combustion chamber 59 for combustion therein. The fuel delivery system preferably includes a fuel tank (not shown) which is normally positioned within the watercraft 24. Fuel is drawn from the fuel tank by a fuel pump 104 through a supply line 105. The supply line 105 extends to a fuel filter 108 which is preferably mounted on a side of the engine 22.

Fuel passing through the filter 108 passes through a fuel line 106 to the pump 104. As illustrated in FIGS. 2 and 3, the fuel pump 104 is positioned on the cover 88 at the end of the engine 22 opposite the watercraft 24.

Fuel is supplied by the pump 104 to a chamber of a vapor separator 110 through a delivery line 109. Fuel is drawn from the chamber of the separator by a high pressure pump 112. Fuel under high pressure is delivered by the pump 112 through a high pressure fuel line 114 to a fuel rail 116. As illustrated and described in more detail below, the fuel rail 116 extends along a side of the engine 22. Fuel is delivered by the rail 116 to a fuel injector 118 corresponding to each combustion chamber 59. Any fuel which is supplied to the rail 116 but which is not delivered by the injectors 118 is routed through a return line 120 through a pressure regulator 122 back into the chamber of the vapor separator 110 for pumping fuel from the tank and delivering it to each combustion chamber 59.

Figure 4:
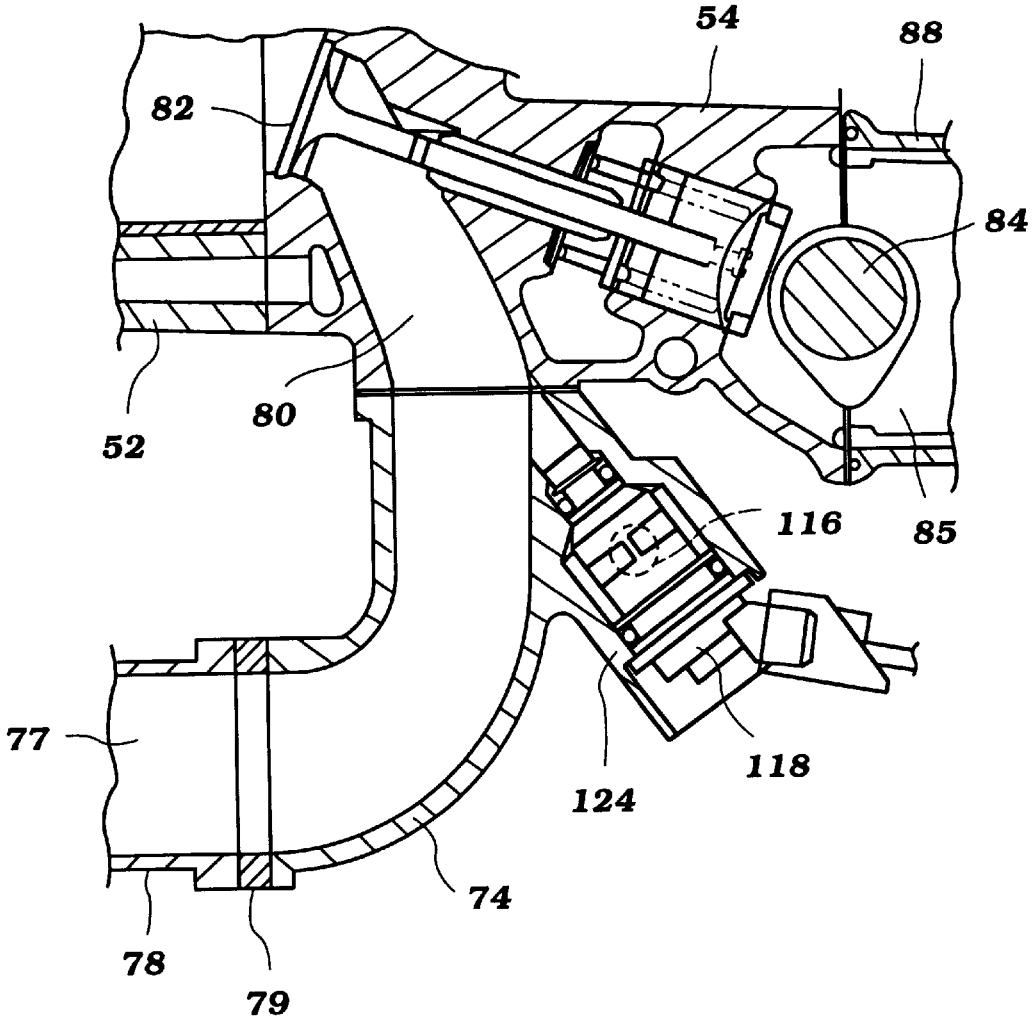
FIG. 4 is an enlarged cross-sectional view of a portion of the engine illustrating the fuel injector arrangement of the engine illustrated in FIG. 2.
Figure 5:
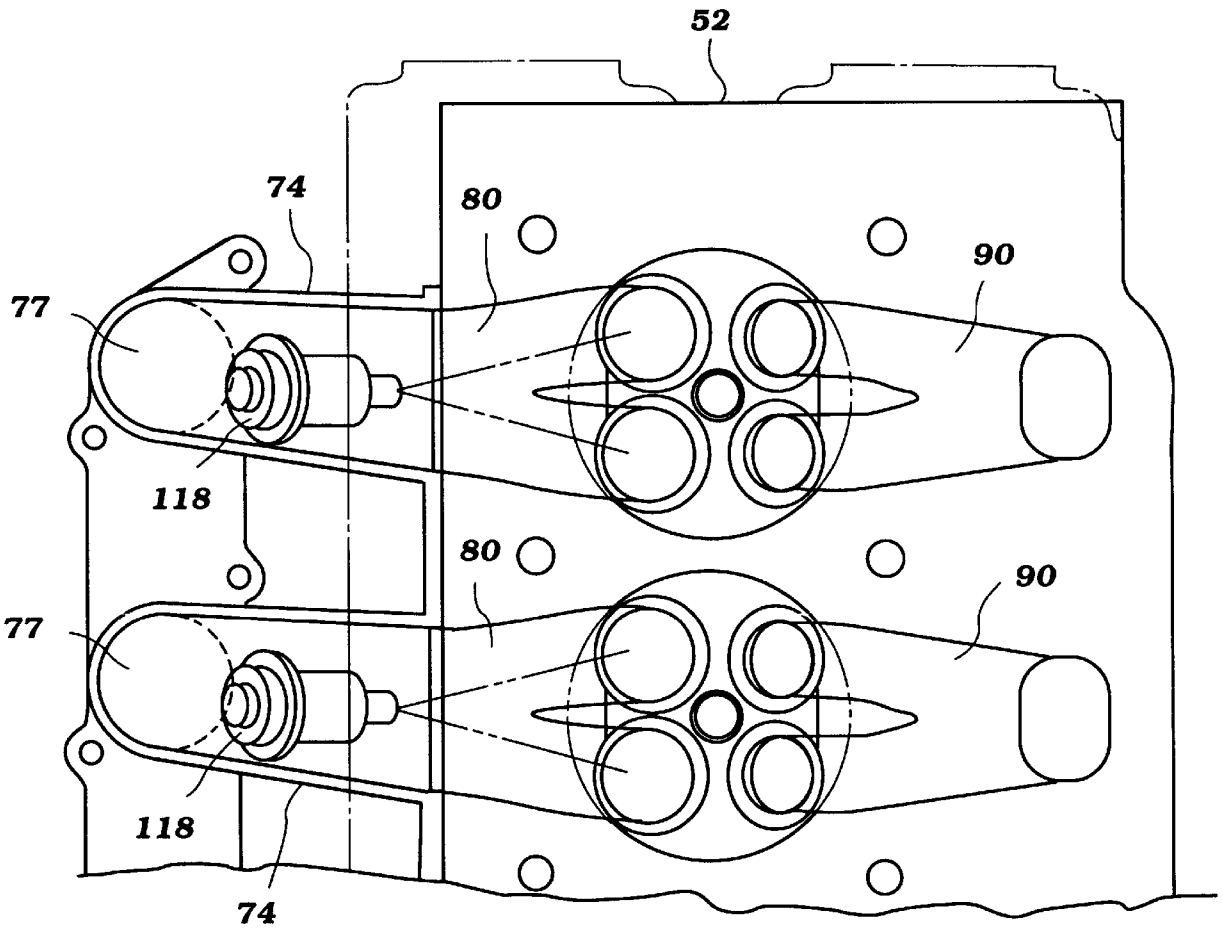
FIG. 5 is a cross-sectional view of the engine illustrated in FIGS. 2 and 3, illustrating the arrangement of each fuel injector with respect to an intake passage leading to a combustion chamber of the engine.

As illustrated in FIGS. 4 and 5, each fuel injector 118 is positioned along the side of the engine between its front and rear ends. In a first embodiment, each fuel injector 118 is mounted to the intake manifold 74 within a boss member 124 extending therefrom. The boss member 124 serves as a protective housing for the injector 118. Most preferably, each injector 118 is oriented so that it sprays fuel in a direction which is generally parallel to the air flowing through the passage 80 at the point of fuel delivery.

As illustrated in FIGS. 2 and 5, each injector 118 is mounted in a generally horizontal plane. In this arrangement, each injector 118 has a body and an injection end, with the body and injection end being generally equidistant from the top end of the engine.

In addition, the fuel rail 116 is preferably formed as a passage through the intake manifold 74.

This arrangement has the benefit that the fuel injectors 118 and fuel rail 116 are positioned along the side of the engine 22 and do not contribute to an increase in engine profile from the front end to the rear end, as is the case when the fuel rail 116 extends along the cover 88 at the end of the engine.

Figure 6:
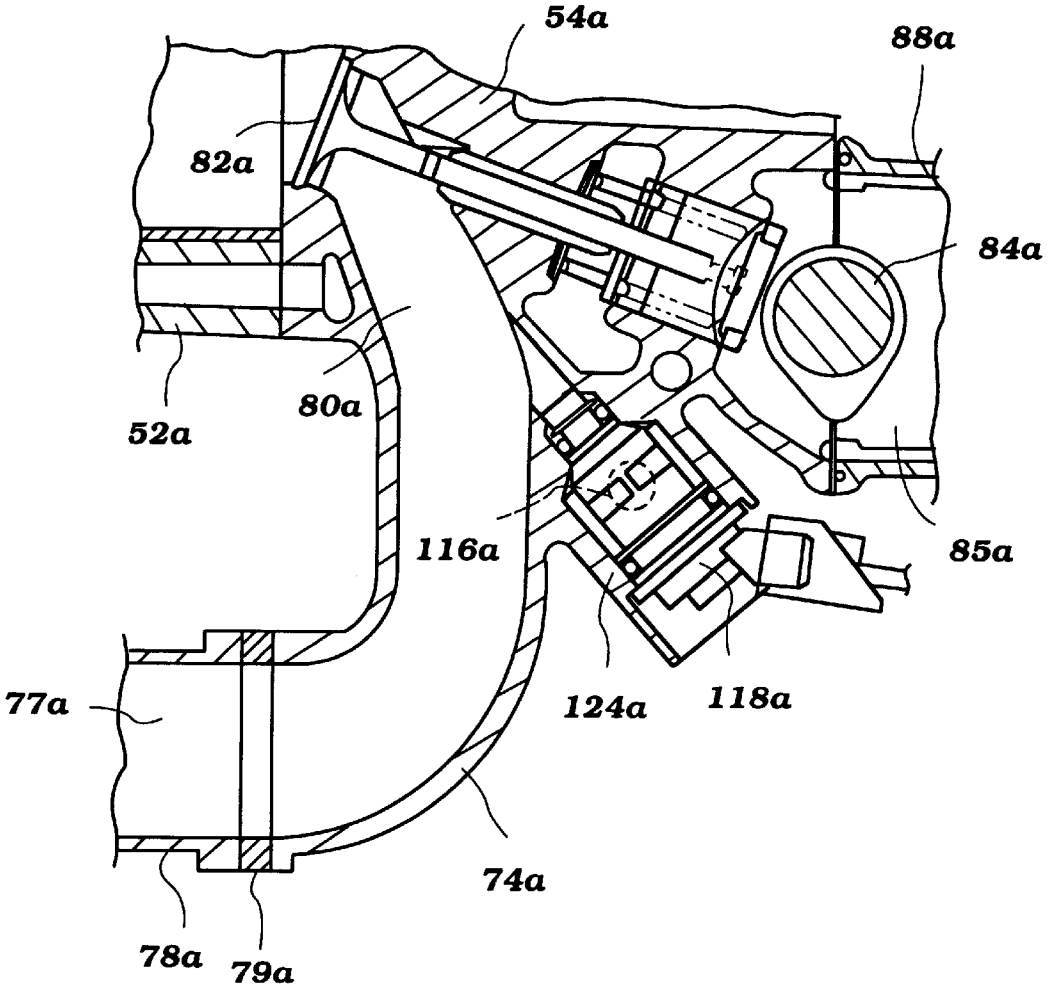
FIG. 6 is an enlarged cross-sectional view of a portion of an engine similar to that illustrated in FIGS. 2–3, but having a fuel injector arrangement in accordance with a second embodiment of the present invention.

FIG. 6 illustrates an alternate embodiment fuel injector arrangement in accordance with a second embodiment of the present invention. In the description and figures of this embodiment system, like numerals have been used with like parts to those described and illustrated above, except that an "a" designator has been added thereto.

In this embodiment, the exhaust manifold 74*a* is integrally formed with the cylinder head 52. In this arrangement, each passage through the manifold 74*a* is simply a portion of an extended passage 80*a* leading through the cylinder head 54*a* to the combustion chamber.

Each fuel injector 118*a* is mounted within a boss 124*a* extending from the cylinder head 54*a*. Preferably, the fuel rail 116*a* comprises a passage extending through the cylinder head 54*a* to each of the fuel injectors 118*a*.

Figure 7:
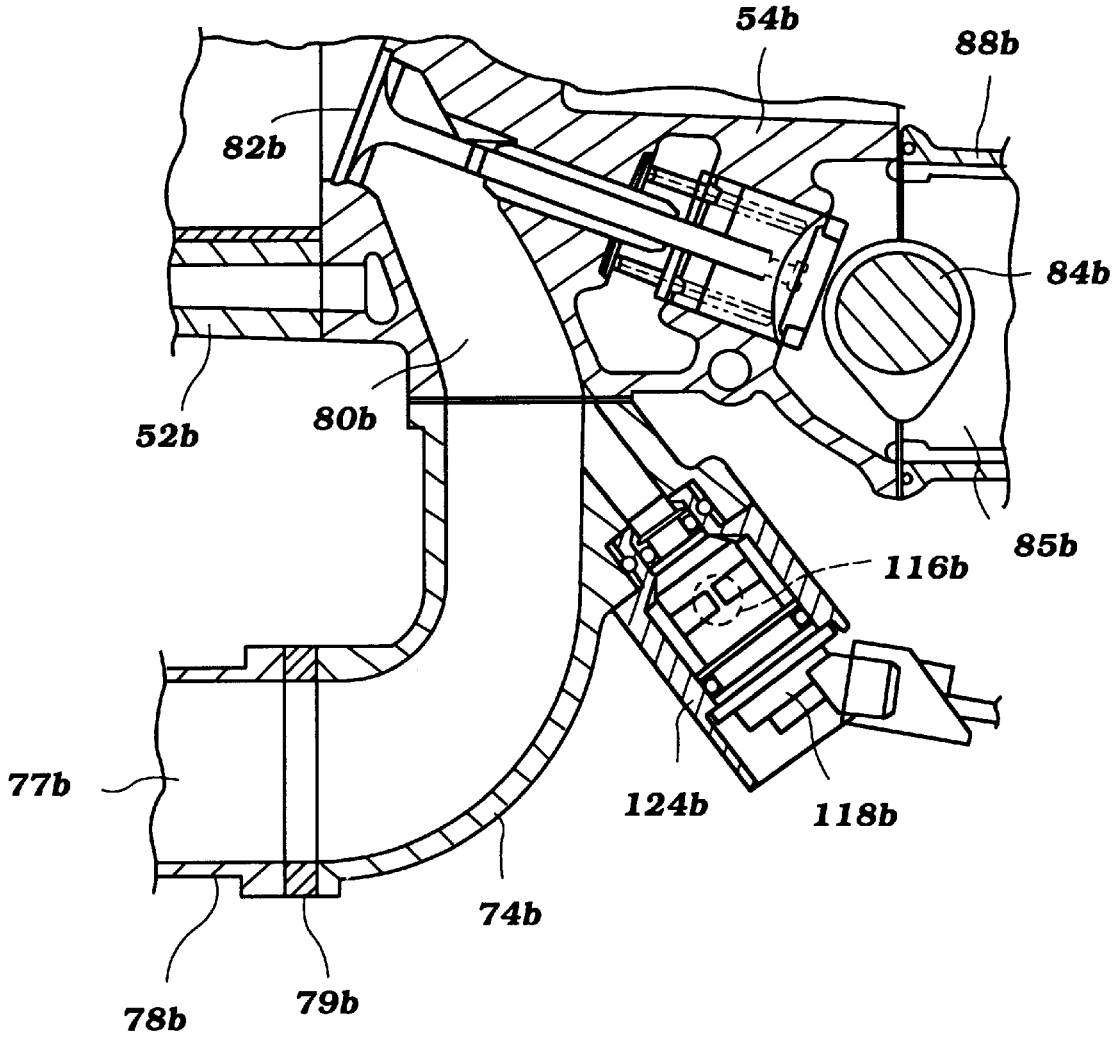
FIG. 7 is a an enlarged cross-sectional view of a portion of an engine similar to that illustrated in FIGS. 2–3, but having a fuel injector arrangement in accordance with a third embodiment of the present invention.

FIG. 7 illustrates an alternate embodiment fuel injector arrangement in accordance with a third embodiment of the present invention. In the description and figures of this embodiment system, like numerals have been used with like parts to those described and illustrated above, except that a "b" designator has been added thereto.

In this embodiment, a mounting part 124*a* is connected to the intake manifold 74*a*. The mounting part 124*a* has individual ports for accepting the body of the injectors 118*a* for mounting and protection. In addition, the mounting part 124*a* has a passage therethrough which serves as the fuel rail 116*a*.

Figure 8:
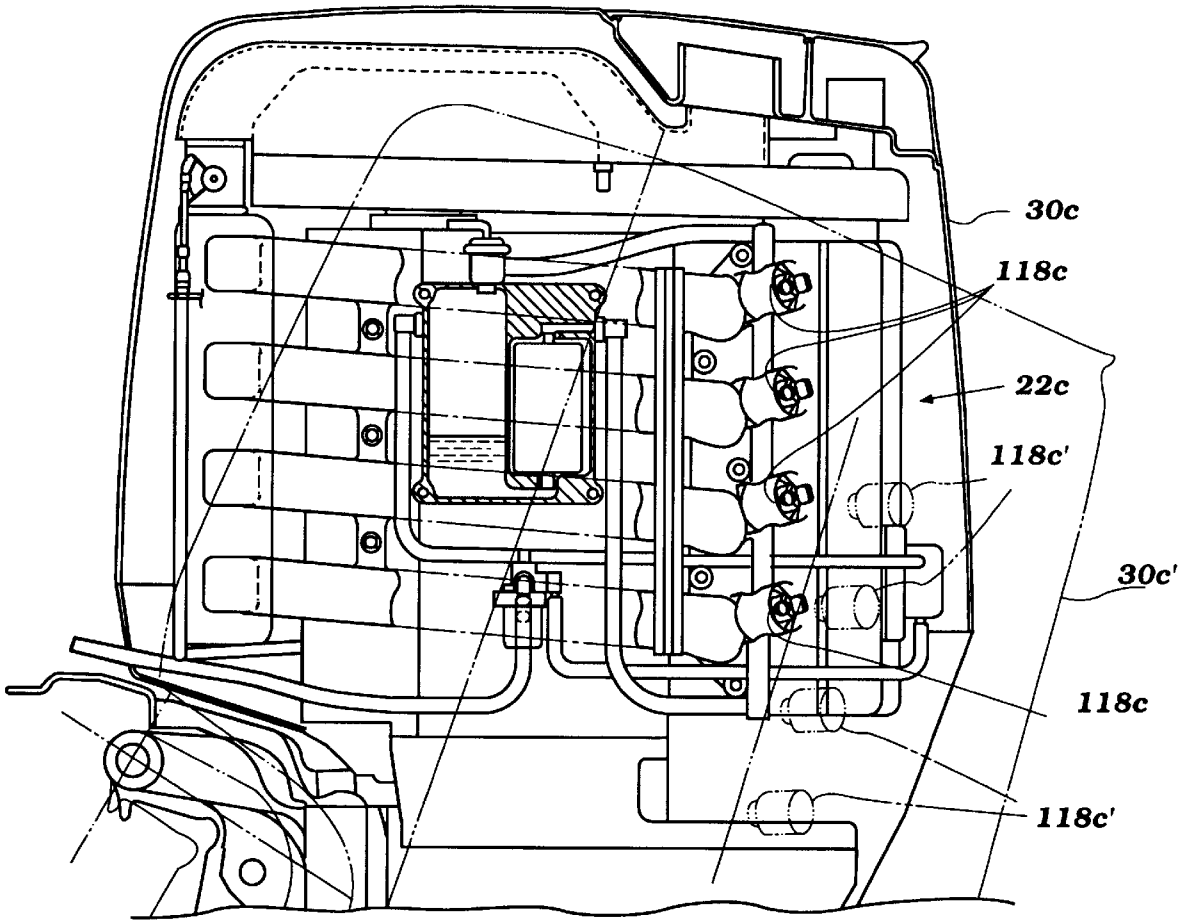
FIG. 8 is a cross-sectional side view of a top portion of a motor similar to that illustrated in FIG. 1, exposing the engine therein and having a fuel injector arrangement in accordance with a fourth embodiment of the present invention.
Figure 9:
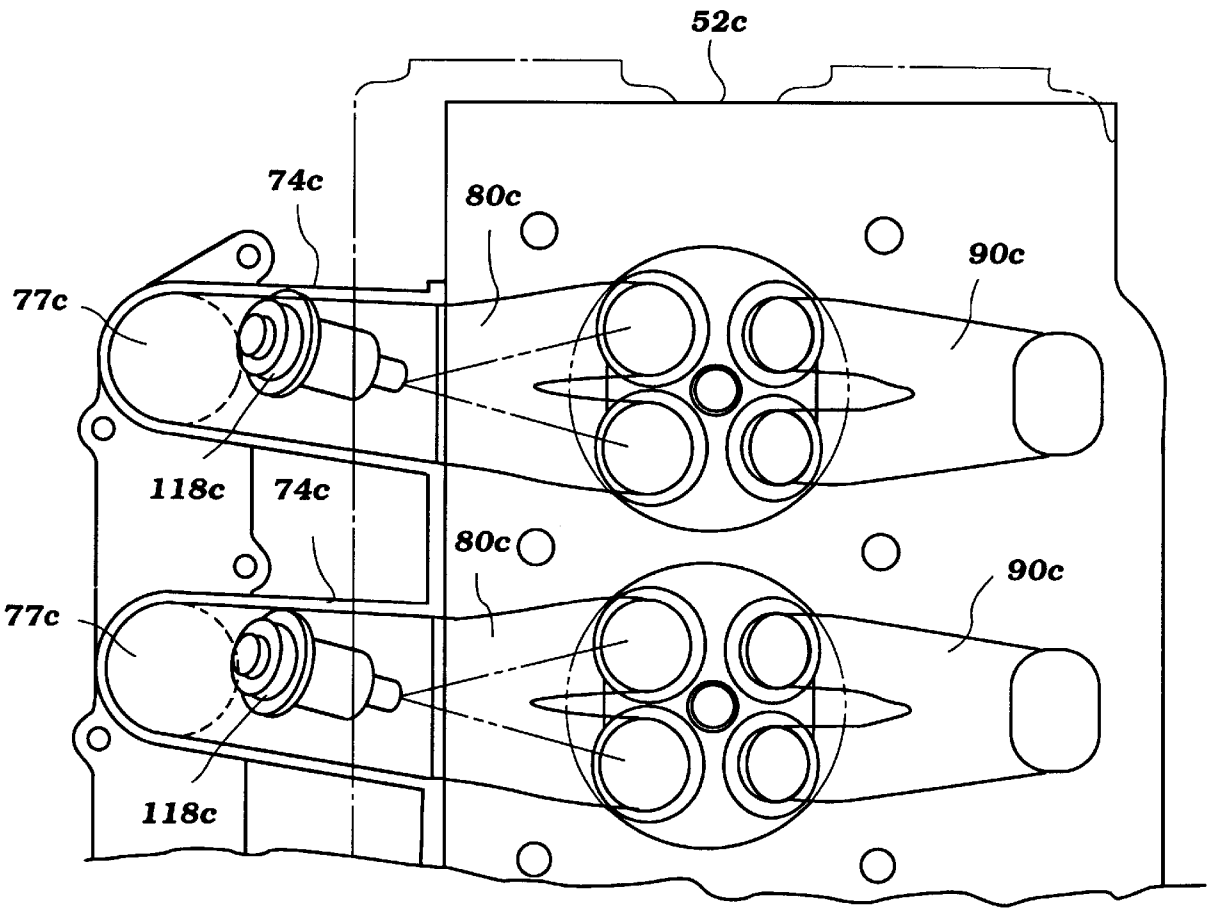
FIG. 9 is a cross-sectional view of the engine illustrated in FIG. 8, illustrating the arrangement of a fuel injector with respect to an intake passage leading to a combustion chamber of the engine in accordance with the fourth embodiment of the present invention.

FIGS. 8 and 9 illustrate an alternate embodiment fuel injector arrangement in accordance with a fourth embodiment of the present invention. In the description and figures of this embodiment system, like numerals have been used with like parts to those described and illustrated above, except that a "c" designator has been added thereto.

In this embodiment, each injector 118*c* is mounted at an angle with respect to the respective intake passage 80*c* into which it injects fuel. In particular, with reference to a horizontal plane through the combustion chamber, each injector 118*c* is mounted to as to direct fuel downwardly towards the plane, instead of along it (as is the case in the embodiment illustrated in FIGS. 2 and 5 described above). So mounted, the body of the injector 118*c* is closer to the top end of the engine 22*c* than the injection end. The angle at which the injectors 118*c* are mounted is illustrated in FIG. 8, where the injectors lie in a horizontal plane when the motor is tilted backwardly into the position illustrated in dotted lines (cowling 30*c*′ and injectors 118*c*′). Also, the dotted line position illustrates how, if vapor lock occurs because of the injectors' tilted position, the injectors may be moved to a position to remedy the vapor lock.

Preferably, each injector 118*c* is mounted to the intake manifold 74*c* via a boss or separate mounting element in a manner similar to that described above and illustrated in FIGS. 6 and 7. In addition, the fuel rail supplying fuel to each injector 118*c* is preferably formed integrally in the manifold 74*c* or mounting element as described above.

In each of the embodiments of the invention described above, the fuel injector arrangement allows for mounting of the injectors at the side of the engine. Since the injectors are mounted at the side of the engine, the fuel rail also extends along the side of the engine. So arranged, the profile of the engine from end to end is not increased. In addition, where the fuel rail is formed integrally within the manifold or injector mounting element, the size of the fuel system is maintained very small.

Of course, the foregoing description is that of preferred embodiments of the invention, and various changes and modifications may be made without departing from the spirit and scope of the invention, as defined by the appended claims.

What is claimed is:

1. A fuel injector arrangement for an internal combustion engine of the type utilized to power an outboard motor of a watercraft, the engine having a vertically extending crankshaft, at least one combustion chamber formed in part by a cylinder bore, a first end and a second end and a side extending therebetween, an intake passage extending through a side of said engine to said combustion chamber, said intake passage having a first, generally straight portion extending from an intake port communicating directly with said combustion chamber in a direction having a flow axis disposed at an acute angle to said engine side and to the axis of said cylinder bore and merging into a second, generally straight portion having a flow axis extending generally perpendicularly to said engine side and to said axis of said cylinder bore, said fuel injection system comprising a fuel injector positioned along said side of said engine and arranged to deliver fuel to air flowing through said second intake passage portion in a direction generally parallel to the flow axis of said first portion.

2. The fuel injector arrangement in accordance with claim 1, wherein said combustion chamber is defined by a cylinder block defining the cylinder bore, a cylinder head connected to said cylinder block and closing said cylinder bore and an intake manifold fixed to said cylinder head on said engine side, said intake passage extending through said cylinder head and said intake manifold, and further including a fuel rail through which fuel is supplied to said fuel injector, said fuel rail comprising a fuel supply passage for delivering fuel directly to said fuel injector formed integrally in one of said cylinder head and said intake manifold.

3. The fuel injector arrangement in accordance with claim 2, wherein said cylinder head includes a boss in which a portion of said fuel injector is mounted and in which said fuel rail and said fuel supply passage is integrally formed.

4. The fuel injector arrangement in accordance with claim 1, wherein said fuel rail and said fuel supply passage is formed integrally in said intake manifold.

5. The fuel injector arrangement in accordance with claim 4, wherein said intake manifold includes an outwardly extending boss in which a portion of said fuel injector is mounted and in which said fuel rail and said fuel supply passage are integrally formed.

6. The fuel injector arrangement in accordance with claim 5, wherein the intake manifold further includes a mounting element detachably connected to the remainder of said intake manifold, said fuel injector mounted at least partially within said mounting element, and wherein said fuel rail and said fuel delivery passage is formed integrally in said mounting element.

7. The fuel injector arrangement in accordance with claim 1, wherein said fuel injector has a body end and a delivery end, and said engine has a top end and a bottom end, and said body end of said injector is positioned closer the top end of said engine than said delivery end.

8. The fuel injector arrangement in accordance with claim 1 wherein the intake passage further includes a third portion joined to said second portion and having a flow axis extend generally parallel to said cylinder bore axis and having an inlet opening spaced transversely outwardly from a cylinder block in which said cylinder bore is formed.

9. A fuel injector arrangement for an internal combustion engine of the type utilized to power an outboard motor of a watercraft, the engine having a vertically extending crankshaft, at least one combustion chamber formed in part by a cylinder head and a cylinder block in which at least one cylinder bore is formed, a first end and a second end and a side therebetween, an intake passage extending through a side of said engine to said combustion chamber, said intake passage being formed in part by a cylinder head and an intake manifold, said cylinder head, said cylinder block and said intake manifold forming an engine body, said fuel injection system comprising a fuel injector positioned along said side of said engine and arranged to deliver fuel to air flowing through said intake passage, and a fuel delivery passage through which fuel is supplied directly to said fuel injector, said fuel delivering passage being integrally formed in said engine body.

10. The fuel injector arrangement in accordance with claim 9, wherein said fuel delivery passage is formed directly in said cylinder head.

11. The fuel injector arrangement in accordance with claim 9, wherein a valve is positioned within said intake passage and said fuel injector delivers said fuel in a portion of said passage opposite said valve from said combustion chamber.

* * * * *